United States Patent [19]

Zajac

[11] Patent Number: 5,042,739

[45] Date of Patent: Aug. 27, 1991

[54] PAYOUT TUBE AND LOCKING PLATE

[75] Inventor: Ronald E. Zajac, Goldens Bridge, N.Y.

[73] Assignee: Windings, Inc., Patterson, N.Y.

[21] Appl. No.: 593,962

[22] Filed: Oct. 9, 1990

[51] Int. Cl.[5] ..... B65H 57/12; B65H 57/18; B65H 55/02

[52] U.S. Cl. ..... 242/157 R; 242/137.1; 242/163; 242/171

[58] Field of Search ..... 242/157 R, 163, 170, 242/171, 137, 137.1, 146

[56] References Cited

U.S. PATENT DOCUMENTS

| | | | |
|---|---|---|---|
| 4,009,845 | 3/1977 | Santucci et al. | 242/137.1 X |
| 4,019,636 | 4/1977 | Wise | 242/163 X |
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |
| 4,373,687 | 2/1983 | Zicko | 242/163 |

*Primary Examiner*—Stanley N. Gilreath
*Attorney, Agent, or Firm*—Watson, Cole, Grindle & Watson

[57] ABSTRACT

The combination of a backing plate member, a hollow tube and a container having coiled filamentary material therein for paying out filamentary material coiled in the container through the tube, with the hollow tube having an end portion including a pair of oppositely disposed projections and the side wall panel including a cut-out portion substantially conforming to the shape of the end portion including the opposed projections. The backing plate member comprising a substantially planar member made of a resilient material and having a cut-out portion and substantially conforming in shape to the shape of the end portion of the tube enabling passage of the end portion through the cut-out portion of the planar member, a first ramped surface being formed on an edge portion of each of the opposing projections and adapted to enable each projection of the tube to be rotated in a given direction onto the surface of the planar member thereby locking the tube with respect to the planar member.

16 Claims, 1 Drawing Sheet

PAYOUT TUBE AND LOCKING PLATE

BACKGROUND OF THE INVENTION

1. Field of the Invention

This invention relates to payout devices removably attached to containers for dispensing coiled strand-like material, and more particularly to such devices using a hollow feed tube guide frictionally engaging a plastic locking plate to be in interlocking relationship with a wall panel of the container such that the strand material can be withdrawn from the hollow payout tube through a hole in the container wall panel without the payout tube dislodging from, or punching-through, the wall panel.

2. Related Art

U.S. Pat. No. 4,019,636 to Wise discloses a dispensing package for coiled strand material using inner and outer feed tubes engageable with the wall panel of a container for paying-out the coiled strand material.

U.S. Pat. No. 4,022,399 to Zajac is directed to a payout tube with respective flanges spaced substantially the same as the thickness of the wall panel and with the outer flange having an outwardly bent portion which rides up the wall of the opening in the container so that the tube can be turned to a position in which the principal part of the outer flange engages against the outside of the wall.

U.S. Pat. No. 4,057,204 to Zajac discloses a payout tube having a flange adjacent the outer end and two outwardly extending projections between the flange and the outer end with a space therebetween. The inner edges of the projections are slanted in opposite directions and the outer end of the tube is brought through an opening having diametrically opposed notches in the corrugated material such that with 90 degree rotation of the tube the projections ride up the wall of the corrugated material and dig into it to prevent accidental turning of the tube.

U.S. Pat. No. 4,274,607 to Priest discloses a guide for elongated filament material which guide is secured by an outer end within an opening in a carton. Restraint means in the form of a plurality of finger barriers are provided within the guide member and cooperate with the elongate filament to prevent its retaction or withdrawal back into the container.

U.S. Pat. No. 4,373,687 to Zicko discloses a hollow feed tube frictionally engaged with an underlying closure flap of a container and interlockingly engaged with the die-cut closure flap of the container.

SUMMARY OF THE INVENTION

Notwithstanding the above developments in the design of payout tubes, there remains a need to provide a payout tube that is removably attachable to a wall panel of a container so that the payout tube can not be withdrawn through the corrugated wall panel by either rotation or punch-through of the tube.

Thus, a primary object of the invention is to prevent such punch-through of the payout tube by providing a backing plate mounted between the payout tube and the wall panel of the container with provision for rotation of the payout tube with respect to the backing plate to removably lock the payout tube and the backing plate in a fixed position with respect to one another.

A feature of the invention to carry out the aforementioned object is the provision of a plastic plate member having a centrally located cut-out portion conforming to the end portion of the payout tube. Diametrically opposed cut-out wing portions of the plate member, conforming to the wing portions of the end portion of the payout tube, each have a ramp portion on each cut-out thereby enabling the diametrically opposed projections on the end of the payout tube to be inserted through a respective cut-out and rotated on the plastic plate member into a removable locking position.

A further feature of the invention is the provision of a stop member located at each cut-out wing portion opposite the ramp portion for limiting rotation of the payout tube with respect to the plastic plate member at the aforementioned locking position.

And still another feature of the invention are opposing spiked projections located diametrically opposite one another along an axis substantially perpendicular to an axis extending through each of the wing cut-out portions accommodating the wing projections on the end of the payout tube for gripping the side wall panel of the container when the payout tube engages the locking plate member in the aforementioned locking relationship.

And yet another feature of the invention to accomplish the aforementioned object is a circularly-shaped plastic locking plate member having ridges spaced about the periphery thereof on the surface opposite the side of the wall panel to strengthen the plastic member.

And yet another feature of the present invention is a pair of oppositely disposed ramps lying in the path of rotational movement of the oppositely disposed projections on the payout tube such that with rotation of the payout tube each of the projections thereon moves up the ramp and then falls off the end of each ramp onto the surface of the plate member which provides a means for impeding reverse rotation of the payout tube.

The plastic locking plate of the present invention is used with wound packages of filamentary material, cartons containing the same and with payout tubes used in conjunction with such wound packages and containers. Thus exemplary wound packages, cartons and payout tubes with which the inventive plastic locking plate may be used are found in the following U.S. Patents all owned by the assignee of the present invention: (1) U.S. Pat. No. 4,019,636; "Strand Package and Carton Therefor"; issued Apr. 26, 1977; (2) U.S. Pat. No. 4,022,399; "Screw-in-Tube with Breakable Tabs for Coil of Flexible Material with Inner End Payout"; issued May 10, 1977; (3) U.S. Pat. No. 4,057,203; "Package of Flexible Material with Oval Payout Tube"; issued Nov. 8, 1977; (4) U.S. Pat. No. 4,057,204; "Tube for Inner End Feed-out of Flexible Material and Package Utilizing the Same"; issued Nov. 8, 1977; and (5) U.S. Pat. No. 4,160,533; "Container in Octagonal Insert and Corner Payout"; issued July 10, 1979.

BRIEF DESCRIPTION OF THE DRAWINGS

The above objects, features and advantages of the invention are believed to be readily apparent from the following description of a preferred embodiment representing the best mode of carrying out the invention when taken in conjunction with the following drawings, wherein.

DETAILED DESCRIPTION

Figure 1:
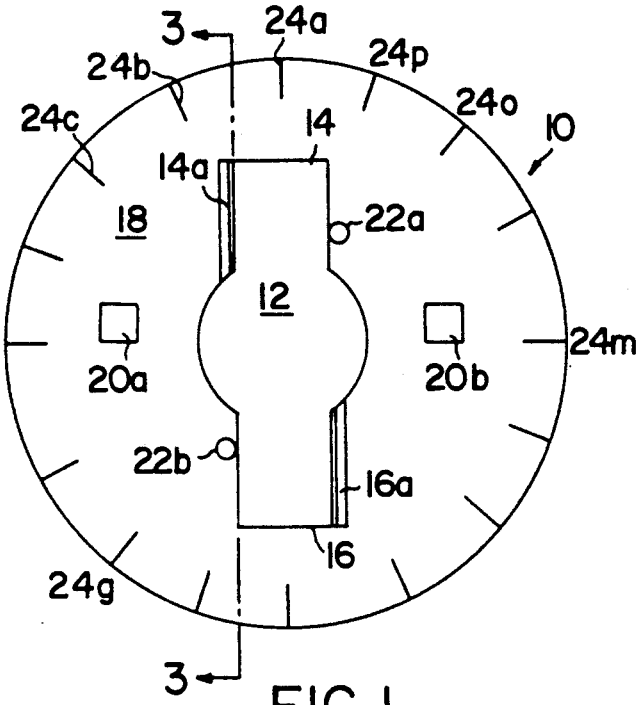
FIG. 1 is a plan view of the side of a locking plate member facing away from the side wall of the container of a preferred embodiment in accordance with the invention.
Figure 4:
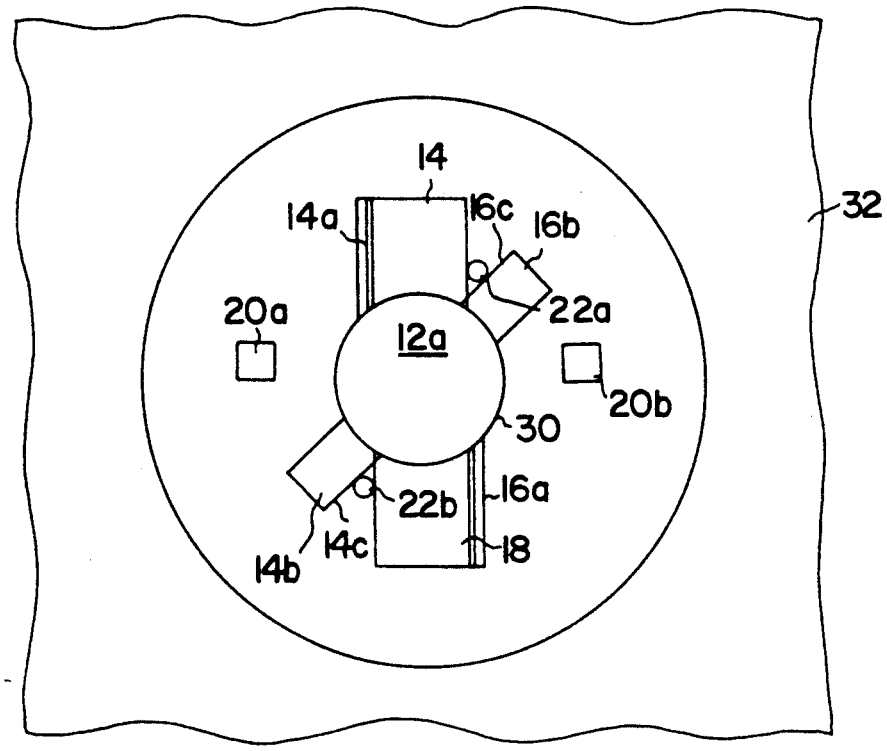
FIG. 4 shows the locking plate member of FIG. 1 in operative engagement with the end of a payout tube as attached to the side wall panel of a container.

The locking plate member 10 may be of any shape but is preferably circular as illustrated in FIG. 1, is made of a plastic such as polyurethane and includes a cut-out portion 12 adapted to fit over the end portion 12*a* (FIG. 4) of a payout tube (not shown) having a circular cross-section with a pair of diametrically opposed projections 14*b*, 16*b* (see FIG. 4). Thus, cut-out portion 12 is configured to enable the end portion 12*a* of a payout tube to fit through cut-out portion 12 and be rotated into the retaining position illustrated in FIG. 4. Diametrically opposed extensions 14, 16 of locking plate member 10 each include a respective ramp portion 14*a*, 16*a* enabling each respective end projection 14*b*, 16*b* of the end portion 12*a* of the payout tube to be counter-clockwise rotated onto the surface 18 of the locking plate member 10 and into the engaged position shown in FIG. 4.

Ramp members 20*a*, 20*b* are formed on the surface 18 of locking plate member 10 as shown in FIG. 1, which ramp members enable the front end portion 14*c*, 16*c* of each projection 14*b*, 16*b* of the payout tube to rotate counterclockwise into the engaging position shown in FIG. 4, but to limit clockwise movement of the payout tube projections 14*b*, 16*b* from that position and thereby prevent the projections 14*b*, 16*b* from becoming aligned with and pass through cut-out portion 12.

Figure 2:
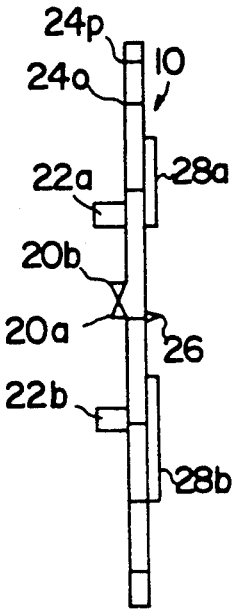
FIG. 2 is a side view of the locking plate member of FIG. 1.
Figure 3:
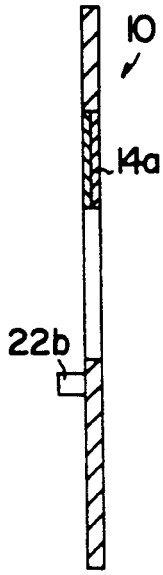
FIG. 3 is a view of the locking plate member along lines 3—3 of FIG. 1.

Stop members 22*a* and 22*b* limit the counterclockwise rotation of extensions 14 and 16. Ridges 24*a*, 24*b*, 24*c* . . . 24*p* strengthen the periphery of locking plate 10. A spiked projecting member 26 at each end of a diameter of locking plate 10 as shown in FIG. 2 digs into the surface of the container (not shown) to aid in anchoring the locking plate member in position on the container surface.

Each stop-like projection 28*a*, 28*b* consists of a pair of spaced members extending outwardly from the bottom of locking plate 10 on each side of a respective extension 14, 16 to engage the container side wall panel 32 to assist in anchoring the locking plate to the container when the end projections 14*b*, 16*b* of end portion of the payout tube are rotated into the locking position shown in FIG. 4.

The plastic backing plate member operates as follows in conjunction with a wall panel of a container to hold a payout tube for paying-out a flexible material from the container through the payout tube as shown in FIG. 4. The end portion 30 of a payout tube is inserted through a cut-out portion (substantially identical to cut-out portion 12 in locking plate member in a container wall panel 32 and backing plate member 10 with cut-out portion 12 is fitted over the end portion of the payout tube with extensions 14 and 16 of the cut-out portion aligned with end projections 14*b* and 16*b* of the payout tube. The cut-out portion (not shown) in the container wall panel 32 corresponds in size and shape to cut-out portion 12 of the backing plate member 10. The payout tube end portion 30 is rotated counterclockwise such that portions 14*c* and 16*c* of the payout tube end portion 30 respectively engage ramp portions 14*a* and 16*a* and, with continued CCW rotation of the payout tube end portion 30, edges 14*c* and 16*c* ride up and over respective ramps 20*a* and 20*b*. The CCW rotation of payout tube end portion 30 continues until edges 14*c* and 16*c* respectively engage stop members 22*b* and 22*a* as shown in FIG. 4, which represents the operative state of the backing plate 10, payout tube end portion 30 and the container wall panel 32.

Those skilled in the winding and reeling art will recognize that the invention as described herein can be modified in various aspects; however, the scope of the claims is not intended to be limited by the above description of the best mode of carrying out the invention. It is intended that the scope of the invention be limited by the following claims and the equivalents to which the various elements thereof are entitled.

What is claimed is:

1. A backing plate member for mounting the end portion of a tube through a cut-out portion in the side wall panel of a container for paying out filamentary material coiled in said container through said tube, said end portion having diametrically opposed projections, comprising:

a substantially planar member made of a resilient material and having a cut-out portion with opposing extensions and conforming in shape to the shape of the end portion of said tube enabling passage of said end portion through the cut-out portion of said planar member, a first ramped surface being formed on an edge portion of each of said opposing extensions and adapted to enable each projection of said tube to be rotated in a given direction onto the surface of said planar member thereby locking said tube with respect to said planar member.

2. A backing plate member as claimed in claim 1, further comprising a pair of second ramped surfaces oppositely disposed on the surface of said planar member, each of said second ramp surfaces receiving the respective leading edge of said opposing extensions in said given direction of rotation inhibiting rotation of said opposing projections.

3. A backing plate member as claimed in claim 1, further comprising a pair of oppositely disposed stop members each located on a respective edge portion of said extensions opposite a respective one of said first ramped surfaces for preventing further rotation of said tube portion in said given direction.

4. A backing plate member as claimed in claim 1, further comprising spiked projections extending from the opposite surface of said backing plate member for engaging the surface of said wall panel to assist in anchoring said backing plate member to said wall panel.

5. A backing plate member as claimed in claim 1, further comprising a plurality of ridge portions extending around the periphery of said backing plate member to strengthen it.

6. A backing plate member as claimed in claim 2, further comprising a pair of oppositely disposed stop members each located on a respective edge portion of said extensions opposite a respective one of said first ramped surfaces for preventing further rotation of said tube portion in said given direction.

7. A backing plate member as claimed in claim 6, further comprising spiked projections extending from the opposite surface of said backing plate member for engaging the surface of said wall panel to assist in anchoring said backing plate member to said wall panel.

8. A backing plate member as claimed in claim 2, further comprising a plurality of ridge portions extending around the periphery of said backing plate member to strengthen it.

9. A backing plate member as claimed in claim 2, further comprising spiked projections extending from the opposite surface of said backing plate member for engaging the surface of said wall panel to assist in anchoring said backing plate member to said wall panel.

10. A backing plate member as claimed in claim 9, further comprising a plurality of ridge portions extending around the periphery of said backing plate member to strengthen it.

11. A backing plate member as claimed in claim 2, further comprising spiked projections extending from the opposite surface of said backing plate member for engaging the surface of said wall panel to assist in anchoring said backing plate member to said wall panel.

12. A backing plate member as claimed in claim 11, further comprising a plurality of ridge portions extending around the periphery of said backing plate member to strengthen it.

13. A backing plate member as claimed in claim 2, further comprising a plurality of ridge portions extending around the periphery of said backing plate member to strengthen it.

14. A backing plate member as claimed in claim 3, further comprising a plurality of ridge portions extending around the periphery of said backing plate member to strengthen it.

15. A backing plate member as claimed in claim 4, further comprising a plurality of ridge portions extending around the periphery of said backing plate member to strengthen it.

16. The combination of a backing plate member, a hollow tube and a container having coiled filamentary material therein for paying out filamentary material coiled in said container through said tube, comprising:

said hollow tube having an end portion including a pair of oppositely disposed projections;

said side wall panel including a cut-out portion substantially conforming to the shape of said end portion and including opposing extensions conforming in shape to said oppositely disposed projections;

said backing plate member comprising a substantially planar member made of a resilient material and having a cut-out portion and substantially conforming in shape to the shape of said end portion of said tube enabling passage of said end portion through the cut-out portion of said planar member, a first ramped surface being formed on an edge portion of each of said opposed extensions and adapted to enable each projection of said tube to be rotated in a given direction onto the surface of said planar member thereby locking said tube with respect to said planar member.

* * * * *

UNITED STATES PATENT AND TRADEMARK OFFICE

CERTIFICATE OF CORRECTION

PATENT NO. : 5,042,739

DATED : August 27, 1991

INVENTOR(S) : Ronald E. Zajac

It is certified that error appears in the above-indentified patent and that said Letters Patent is hereby corrected as shown below:

In claim 2 at column 4, line 40, delete "extensions" insert --projections--.

Signed and Sealed this

Sixteenth Day of August, 1994

Bruce Lehman

*Attest:*

BRUCE LEHMAN

*Attesting Officer*

*Commissioner of Patents and Trademarks*